US010159879B2

(12) United States Patent
Jertson et al.

(10) Patent No.: US 10,159,879 B2
(45) **Date of Patent: *Dec. 25, 2018**

(54) CLUB HEADS FOR ADJUSTING VERTICAL SPIN OF A GOLF BALL AND METHODS OF PROVIDING THE SAME

(71) Applicant: Karsten Manufacturing Corporation, Pheonix, AZ (US)

(72) Inventors: Marty R. Jertson, Phoenix, AZ (US); Eric Joel Morales, Laveen, AZ (US); Anthony D. Serrano, Anthem, AZ (US); Bradley D. Schweigert, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/650,527

(22) Filed: Jul. 14, 2017

(65) Prior Publication Data

US 2017/0312597 A1 Nov. 2, 2017

Related U.S. Application Data

(63) Continuation of application No. 14/859,104, filed on Sep. 18, 2015, now Pat. No. 9,737,772, which is a continuation of application No. 13/955,644, filed on Jul. 31, 2013, now Pat. No. 9,162,120.

(60) Provisional application No. 61/717,262, filed on Oct. 23, 2012.

(51) Int. Cl.

| | |
|---|---|
| ***A63B 53/06*** | (2015.01) |
| ***A63B 60/00*** | (2015.01) |
| ***A63B 53/04*** | (2015.01) |
| *A63B 53/00* | (2015.01) |

(52) U.S. Cl.

CPC ..... *A63B 60/00* (2015.10); *A63B 53/04* (2013.01); *A63B 53/0466* (2013.01); *A63B 53/06* (2013.01); *A63B 53/047* (2013.01); *A63B 53/0487* (2013.01); *A63B 2053/005* (2013.01); *A63B 2053/0433* (2013.01); *A63B 2053/0491* (2013.01)

(58) Field of Classification Search

CPC ..... A63B 2053/005; A63B 60/00; A63B 53/0466; A63B 53/04; A63B 2053/0433; A63B 2053/0491; A63B 53/047; A63B 53/0487; A63B 53/06

See application file for complete search history.

(56) References Cited

U.S. PATENT DOCUMENTS

| | | | |
|---|---|---|---|
| 1,133,129 | A | 3/1915 | Govan |
| 1,518,316 | A | 12/1924 | Ellingham |
| 1,840,924 | A | 1/1932 | Tucker |
| 2,163,091 | A | 6/1939 | Held |
| 2,954,231 | A | 9/1960 | MacIntyre |
| 3,143,349 | A | 8/1964 | MacIntyre |
| 3,419,275 | A | 12/1968 | Winkleman |
| 3,556,533 | A | 1/1971 | Hollis |

(Continued)

FOREIGN PATENT DOCUMENTS

| | | |
|---|---|---|
| GB | 2195546 | 4/1988 |
| JP | 2006000435 | 1/2006 |

(Continued)

*Primary Examiner* — Stephen Blau

(57) ABSTRACT

Some embodiments include a club head for adjusting vertical spin of a golf ball. Other embodiments of related systems and methods are also disclosed.

19 Claims, 13 Drawing Sheets

(56) References Cited

U.S. PATENT DOCUMENTS

| | | | |
|---|---|---|---|
| 3,652,094 | A | 3/1972 | Glover |
| 3,692,306 | A | 9/1972 | Glover |
| 3,961,796 | A | 6/1976 | Thompson |
| 3,979,123 | A | 9/1976 | Belmont |
| 4,423,874 | A | 1/1984 | Stuff, Jr. |
| 4,754,977 | A | 7/1988 | Sahm |
| 4,869,507 | A | 9/1989 | Sahm |
| 4,944,515 | A | 7/1990 | Shearer |
| 5,050,879 | A | 9/1991 | Sun |
| 5,058,895 | A | 10/1991 | Igarashi |
| 5,082,278 | A | 1/1992 | Hsien |
| 5,244,210 | A | 9/1993 | Au |
| 5,246,227 | A | 9/1993 | Sun et al. |
| 5,431,401 | A | 7/1995 | Smith |
| 5,439,222 | A | 8/1995 | Kranenberg |
| 5,489,097 | A | 2/1996 | Simmons |
| 5,533,730 | A | 7/1996 | Ruvang |
| 5,570,886 | A | 11/1996 | Rigal et al. |
| 5,571,053 | A | 11/1996 | Lane |
| 5,643,110 | A | 7/1997 | Igarashi |
| 5,669,827 | A | 9/1997 | Nagamoto |
| 5,683,309 | A | 11/1997 | Reimers |
| 5,769,737 | A | 6/1998 | Holladay et al. |
| 5,795,245 | A | 8/1998 | Chang et al. |
| 6,059,669 | A | 5/2000 | Pearce |
| 6,102,813 | A | 8/2000 | Dill |
| 6,206,790 | B1 | 3/2001 | Kubica et al. |
| 6,254,494 | B1 | 7/2001 | Hasebe et al. |
| 6,270,422 | B1 | 8/2001 | Fisher |
| 6,306,048 | B1 | 10/2001 | McCabe et al. |
| 6,348,014 | B1 | 2/2002 | Chiu |
| 6,409,612 | B1 | 6/2002 | Evans et al. |
| 6,485,375 | B1 | 11/2002 | McKinley |
| 6,749,523 | B1 | 6/2004 | Forzano |
| 6,926,615 | B1 | 8/2005 | Souza et al. |
| 7,048,639 | B2 | 5/2006 | Grace |
| 7,083,530 | B2 | 8/2006 | Wahl et al. |
| 7,153,215 | B2 | 12/2006 | Peterson et al. |
| 7,153,220 | B2 | 12/2006 | Lo |
| 7,198,575 | B2 | 4/2007 | Beach et al. |
| D574,050 | S | 7/2008 | Jones et al. |
| 7,588,502 | B2 | 9/2009 | Nishino |
| 7,594,865 | B2 | 9/2009 | Ines |
| 7,611,424 | B2 | 11/2009 | Nagai et al. |
| 7,670,232 | B2 | 3/2010 | Franklin et al. |
| 7,670,235 | B2 | 3/2010 | Lo |
| 7,682,263 | B2 | 3/2010 | Yamamoto |
| 7,744,485 | B2 | 6/2010 | Jones et al. |
| 7,824,277 | B2 | 7/2010 | Bennett |
| 7,771,291 | B1 | 8/2010 | Willett et al. |
| 7,887,432 | B2 | 2/2011 | Jones et al. |
| 7,934,999 | B2 | 5/2011 | Cackett et al. |
| 8,016,694 | B2 | 9/2011 | Llewellyn et al. |
| 8,197,358 | B1 | 6/2012 | Watson et al. |
| 8,202,175 | B2 | 6/2012 | Ban |
| 9,421,432 | B2 | 8/2016 | Galvin |
| 2002/0032075 | A1 | 3/2002 | Vatsvog |
| 2002/0137576 | A1 | 9/2002 | Dammen |
| 2006/0030420 | A1 | 2/2006 | Roake |
| 2006/0058112 | A1 | 3/2006 | Haralason et al. |
| 2006/0178229 | A1 | 8/2006 | Liang |
| 2007/0129164 | A1 | 6/2007 | Shimazaki |
| 2007/0135231 | A1 | 6/2007 | Lo |
| 2007/0149315 | A1 | 6/2007 | Bennett et al. |
| 2008/0146369 | A1 | 6/2008 | Wahl et al. |
| 2009/0118034 | A1 | 5/2009 | Yokota |
| 2010/0144461 | A1 | 6/2010 | Ban |
| 2013/0109501 | A1 | 5/2013 | Stites et al. |
| 2013/0190100 | A1 | 7/2013 | Oldknow et al. |

FOREIGN PATENT DOCUMENTS

| | | |
|---|---|---|
| JP | 2006198251 | 8/2006 |
| TW | I260991 | 2/2005 |

CLUB HEADS FOR ADJUSTING VERTICAL SPIN OF A GOLF BALL AND METHODS OF PROVIDING THE SAME

CROSS-REFERENCE TO RELATED APPLICATIONS

This is a continuation of U.S. Non-provisional application Ser. No. 14/859,104, filed Sep. 18, 2015, which is a continuation of U.S. Non-provisional application Ser. No. 13/955,644, filed Jul. 31, 2013, now U.S. Pat. No. 9,162,120, issued Oct. 20, 2015, which claims the benefit of U.S. Provisional Application No. 61/717,262, filed Oct. 23, 2012, the contents all of which are fully incorporated herein.

TECHNICAL FIELD

This disclosure relates generally to sports equipment, and relates more particularly to club heads and related methods.

BACKGROUND

The initial spin rate and spin direction that a golf club head imparts on a golf ball at impact can affect both the distance the golf ball travels and the flight path of the golf ball. For example, as a result of the Magnus effect, the spin rate and spin direction of a golf ball can affect the aerodynamic lift forces acting on the golf ball while the golf ball travels through the air. The spin rate and spin direction can be broken up into vertical and horizontal components. Specifically, the vertical spin rate and direction of the golf ball can affect the vertical aerodynamic lift forces acting on the golf ball (e.g., resulting in an upward or downward force acting on the golf ball, depending on the rate and/or direction of vertical rotation). Furthermore, the horizontal spin rate and direction of the golf ball can affect the horizontal aerodynamic lift forces acting on the golf ball (e.g., resulting in a leftward or rightward force acting on the golf ball, depending on the rate and/or direction of horizontal rotation).

Minor horizontal rotation can result in a fade (rightward) or draw (leftward) bias in the flight path of the golf ball while greater horizontal rotation can result in the golf ball slicing right or hooking left. Meanwhile, vertical rotation can affect the vertical flight path of the golf ball. For example, for a backward spinning golf ball, increasing the spin rate of the golf ball can increase an upward lift force acting on the golf ball to help carry the golf ball through the air. However, like any projectile, too much lift or too little lift can reduce the total forward distance traveled by the golf ball. The optimal vertical spin rate varies, and can depend on the initial forward ball speed of the golf ball and the playing conditions (e.g., weather).

For a wood-type club head, the applied spin rate and/or direction, the center of gravity and/or moment of inertia, and the characteristic time of the club head can all contribute to the desirability for use of the club head because each of these factors can affect the distance a golf ball travels, the launch angle of the golf ball, the spin rate and/or direction of the golf ball at impact, and/or the forgiveness of the club head.

BRIEF DESCRIPTION OF THE DRAWINGS

To facilitate further description of the embodiments, the following drawings are provided in which.

Figure 1:
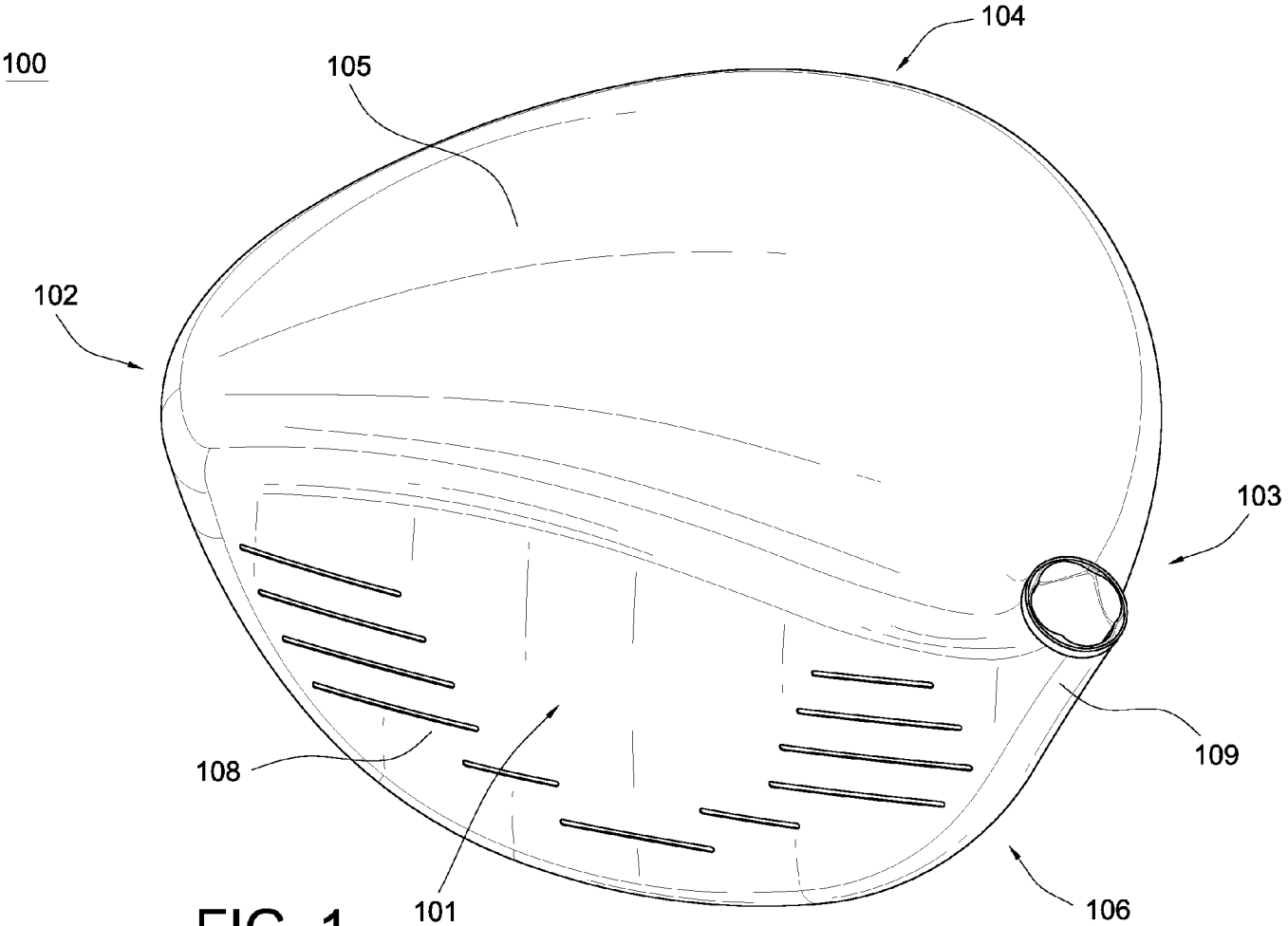
FIG. 1 is a top, front perspective view of a club head, according to an embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, mechanically and/or otherwise. For example, two or more mechanical elements may be mechanically coupled, but not be otherwise coupled. Coupling may be for any length of time, e.g., permanent or semi-permanent or only for an instant.

"Mechanical coupling" and the like should be broadly understood and include mechanical coupling of all types.

The absence of the word "removably," "removable," and the like near the word "coupled," and the like does not mean that the coupling, etc. in question is or is not removable.

In many examples as used herein, the term "approximately" can be used when comparing one or more values, ranges of values, relationships (e.g., position, orientation, etc.) or parameters (e.g., velocity, acceleration, mass, temperature, spin rate, spin direction, etc.) to one or more other values, ranges of values, or parameters, respectively, and/or when describing a condition (e.g., with respect to time), such as, for example, a condition of remaining constant with respect to time. In these examples, use of the word "approximately" can mean that the value(s), range(s) of values, relationship(s), parameter(s), or condition(s) are within ±0.5%, ±1.0%, ±2.0%, ±3.0%, ±5.0%, and/or ±10.0% of the related value(s), range(s) of values, relationship(s), parameter(s), or condition(s), as applicable.

DESCRIPTION

Some embodiments include a golf club head. The golf club head comprises a club head body and a weighting mechanism. The weighting mechanism comprises a first configuration and a second configuration. When the weighting mechanism is configured in the first configuration and a user hits a golf ball with the golf club head in a predetermined manner, the golf ball breaks contact with the golf club head (i) with a first vertical spin rate, (ii) with a first horizontal spin rate, and (iii) with a first horizontal spin direction. Meanwhile, when the weighting mechanism is configured in the second configuration and the user hits the golf ball with the golf club head in the predetermined manner, the golf ball breaks contact with the golf club head (i) with a second vertical spin rate, (ii) with approximately the first horizontal spin rate, and (iii) with approximately the first horizontal spin direction. Further, the second vertical spin rate is different than the first vertical spin rate.

Further embodiments include a set of golf club heads. The set of golf club heads comprises a first golf club head and a second golf club head. The first golf club head comprises a first club head body and a first weighting mechanism arranged in a first arrangement. The first weighting mechanism comprises a first configuration and a second configuration. When the first weighting mechanism is configured in the first configuration and a user hits a golf ball with the first golf club head in a predetermined manner, the golf ball breaks contact with the first golf club head (i) with a first vertical spin rate, (ii) with a first horizontal spin rate, and (iii) with a first horizontal spin direction. Meanwhile, when the first weighting mechanism is configured in the second configuration and the user hits the golf ball with the first golf club head in the predetermined manner, the golf ball breaks contact with the first golf club head (i) with a second vertical spin rate, (ii) with approximately the first horizontal spin rate, and (iii) with approximately the first horizontal spin direction. Further, the second vertical spin rate is different than the first vertical spin rate. Likewise, the second golf club head comprises a second club head body and a second weighting mechanism arranged in a second arrangement. The second weighting mechanism comprises a third configuration and a fourth configuration. When the second weighting mechanism is configured in the third configuration and the user hits the golf ball with the second golf club head in the predetermined manner, the golf ball breaks contact with the second golf club head (i) with a third vertical spin rate, (ii) with a second horizontal spin rate, and (iii) with a second horizontal spin direction. Meanwhile, when the second weighting mechanism is configured in the fourth configuration and the user hits the golf ball with the second golf club head in the predetermined manner, the golf ball breaks contact with the second golf club head (i) with a fourth vertical spin rate, (ii) with approximately the second horizontal spin rate, and (iii) with approximately the second horizontal spin direction. Further, the fourth vertical spin rate is different than the third vertical spin rate.

Other embodiments include a method of providing a golf club head. The method comprises: providing a club head body; and providing a weighting mechanism. The weighting mechanism comprises a first configuration and a second configuration. When the weighting mechanism is configured in the first configuration and a user hits a golf ball with the golf club head in a predetermined manner, the golf ball breaks contact with the golf club head (i) with a first vertical spin rate, (ii) with a first horizontal spin rate, and (iii) with a first horizontal spin direction. Meanwhile, when the weighting mechanism is configured in the second configuration and the user hits the golf ball with the golf club head in the predetermined manner, the golf ball breaks contact with the golf club head (i) with a second vertical spin rate, (ii) with approximately the first horizontal spin rate, and (iii) with approximately the first horizontal spin direction. Further, the second vertical spin rate is different than the first vertical spin rate.

Turning to the drawings, FIG. 1 illustrates a top, front perspective view of club head 100, according to an embodiment. Club head 100 is merely exemplary and is not limited to the embodiments presented herein. Club head 100 can be employed in many different embodiments or examples not specifically depicted or described herein. As explained below, club head 100 can allow for adjustment of the spin rate and/or direction applied by club head 100 to a golf ball. In many embodiments, club head 100 can allow for adjustment of the applied vertical spin rate and/or direction of club head 100 while having minimal and/or negligible effect on the horizontal spin rate and/or direction applied by club head 100 to the golf ball.

Figure 2:
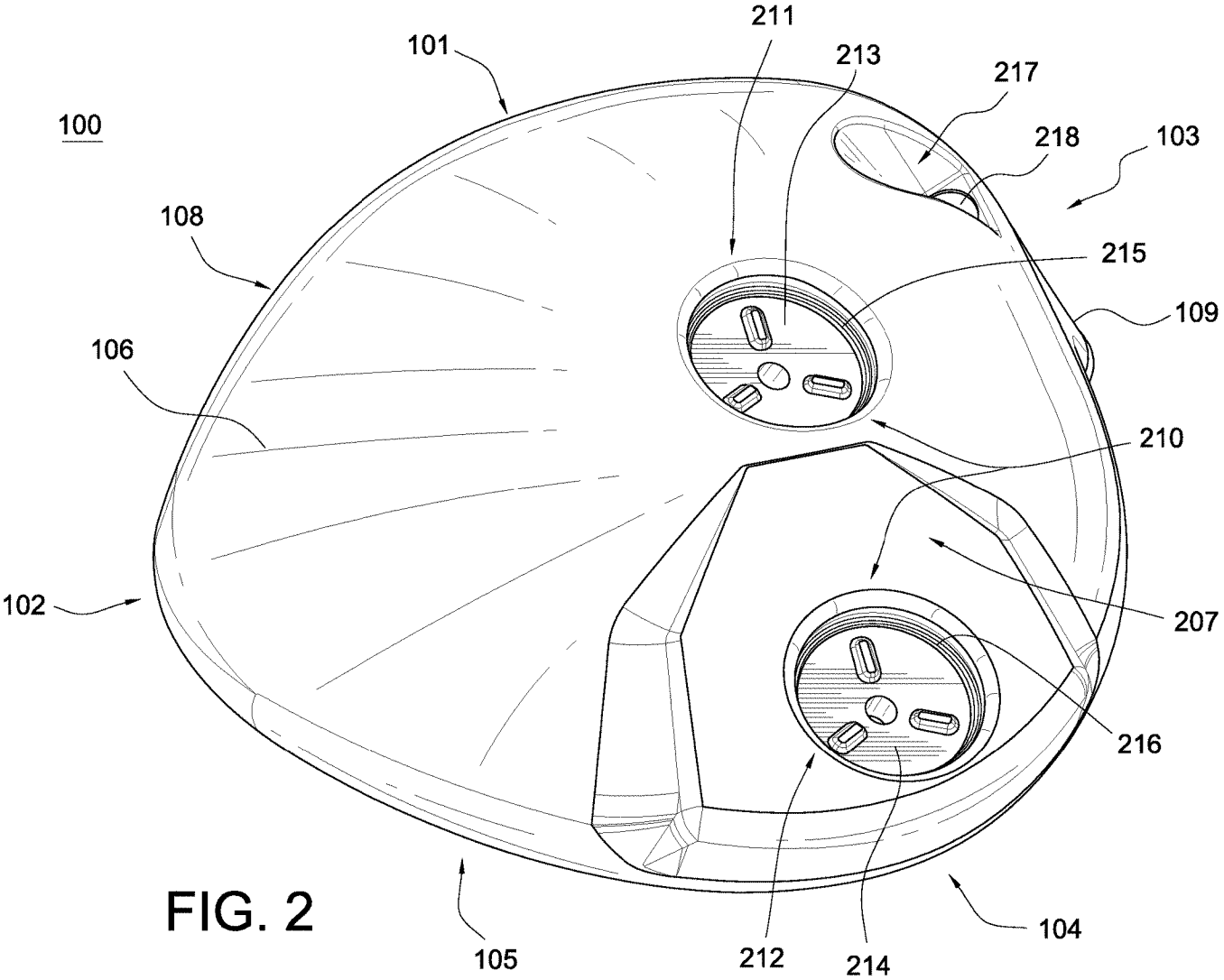
FIG. 2 is a bottom, rear perspective view of the club head, according to the embodiment of FIG. 1.

Club head 100 comprises a front end 101, a toe end 102, a heel end 103, a rear end 104, a crown 105, a sole 106, a weighting mechanism 207 (FIG. 2), and a club face 108. In many embodiments, front end 101 comprises club face 108. Club face 108 can refer to a striking face and/or striking plate of club head 100. Meanwhile, in various examples, sole 106 can comprise part of weighting mechanism 207 (FIG. 2). Toe end 102 can be opposite heel end 103; front end 101 can be opposite from rear end 104; and/or crown 105 can be opposite sole 106. Further, club head 100 can comprise hosel 109. Hosel 109 can be configured to receive a club shaft. Accordingly, in many examples, club head 100 can be part of a golf club. That is, club head 100 can be a club head of a golf club (i.e., a golf club head). Further still, the golf club can be one club head in a set of club heads, and one or more of the other club heads of the set of club heads can be similar to club head 100.

In some embodiments, for reference purposes, front end 101, toe end 102, heel end 103, rear end 104, crown 105, sole 106, and club face 108 can refer to a club head body of club head 100. Meanwhile, in some examples, part of weighting mechanism 207 (FIG. 2) can also be part of the club head body (e.g., when sole 106 comprises part of weighting mechanism 207 (FIG. 2)), while in other examples, weighting mechanism 207 (FIG. 2) and the club head body can be separate elements. Further, in many examples, hosel 109 can also be part of the club head body.

For example, club head 100 can comprise any suitable wood-type golf club head (e.g., a driver club head, a fairway wood club head, a hybrid club head, etc.). In many embodiments, club head 100 can comprise a metal wood golf club head, but club head 100 can comprise any other suitable material. In various embodiments, club head 100 can be hollow. Nonetheless, although club head 100 is generally described in implementation with respect to a wood-type golf club, club head 100 can also be implemented with any other suitable club-type.

Regardless of club-type, weighting mechanism 207 (FIG. 2) is configured to be adjustable between multiple configurations (e.g., a first configuration, a second configuration, a third configuration, etc.). Further, club head 100 and weighting mechanism 207 (FIG. 2) are configured such that when a user hits a golf ball with club head 100 (i.e., at club face 108) in a predetermined manner, club head 100 applies a different vertical spin rate (e.g., rotation per unit time) to the golf ball when the golf ball impacts and breaks contact with club head 100 for each configuration of weighting mechanism 207 (FIG. 2) while minimally and/or negligibly affecting (e.g., changing) the horizontal spin rate and/or horizontal spin direction of the golf ball, or one or more other launch conditions of the golf ball, for the various configurations. Indeed, in many embodiments, the horizontal spin rate and/or horizontal spin direction applied to the golf ball between one or more of the configurations of weighting mechanism 207 (FIG. 2) can be approximately constant.

Reference in the preceding paragraph to the predetermined manner of hitting the golf ball with club head 100 is not intended to be limiting (i.e., to indicate club head 100 must necessarily be used in a particular manner), but rather, to indicate that the effects of weighting mechanism 207 (FIG. 2) on club head 100 can depend on the consistency of the manner in which the user hits the golf ball with club head 100. For example, the effect of weighting mechanism 207 (FIG. 2) on the golf ball can be inconsistent if the location of contact, the speed of club head 100 at contact, the orientation of club face 108, and/or any other relevant hitting conditions do not remain constant between swings. In many examples, the vertical spin direction can remain the same for each of the configurations, but in some examples, the vertical spin direction can change between one or more of the configurations of weighting mechanism 207 (FIG. 2).

By allowing a user to adjust (i.e., increase and/or decrease) the vertical spin rate and/or to adjust the spin direction applied by club head 100 based on playing conditions and/or the user's swing, weighting mechanism 207 (FIG. 2) can give the user more control over the golf ball's flight path in general and can give the user the ability to fine tune club head 100. Adjustments (i.e., increase and/or decrease) to the vertical spin rate and/or the spin direction applied by club head 100 to a golf ball can be made in real time (i.e., at any time) and/or only before starting a round of golf, such as, for example, when rules and regulations restrict when such adjustments can be made. In various examples, when the play condition is windy, and depending on the direction of the wind, weighting mechanism 107 can be adjusted to account for the wind. For some wind conditions and for some directions of the wind, weighting mechanism 107 can be adjusted to a configuration decreasing the vertical spin rate applied to a golf ball so that the wind has less effect on the flight path of the golf ball. In other examples, when the playing condition is wet and/or humid, weighting mechanism 207 (FIG. 2) can be adjusted to a configuration increasing the vertical spin rate applied to a golf ball and, therefore, the upward lift on the golf ball, to combat the decreased air density resulting from the wet and/or humid playing conditions. The increased vertical spin rate can also compensate for aerodynamic drag resulting from accumulated moisture on the golf ball.

In any event, as stated previously, applying too much or too little vertical spin on a golf ball when hitting the golf ball with club 100 can result in an undesirable reduction in the forward distance traveled by a golf ball. Accordingly, in many embodiments, weighting mechanism 207 (FIG. 2) can be configured generally so that the vertical spin rate applied to the golf ball remains within a predetermined range of vertical spin rates regardless of the specific configuration of weighting mechanism 207 (FIG. 2) that is used. For example, weighting mechanism 207 (FIG. 2) can be configured to apply a vertical spin rate to a golf ball of greater than or equal to approximately 350 rotations per minute and less than or equal to approximately 400 rotations per minute. However, in other examples, other higher or lower ranges of vertical spin rates can be applied.

Weighting mechanism 207 (FIG. 2) can affect the vertical spin rate and/or direction that club head 100 applies to a golf ball when the golf ball impacts and breaks contact with club head 100 by repositioning the location of the club head center of gravity of the club head 100. Specifically, repositioning the club head center of gravity of club head 100 can change a gear effect applied to the golf ball by club head 100. The gear effect can refer to a tendency of club head 100 to turn about the club head center of gravity of club head 100 upon contacting the golf ball. The gear effect induces a spin on the golf ball contrary to a torsional direction of the mass of club head 100 turning about the club head center of gravity, resembling the motion of two gears from which the term "gear effect" is derived. Redistributing (e.g., rearranging, moving, increasing, and/or decreasing) mass in club head 100 (i.e., with weighting mechanism 207 (FIG. 2)) changes the location of the club head center of gravity of club head 100 and thereby changes the gear effect that club head 100 applies to the golf ball. Accordingly, weighting mechanism 207 (FIG. 2) can be configured so that each of the one or more configurations of weighting mechanism 207 (FIG. 2) redistribute mass in club head 100 to reposition the club head center of gravity.

For example, redistributing mass closer to or farther from sole 106 can affect the vertical spin rate and/or direction of the golf ball as a result of the gear effect of club head 100 on the golf ball. Further, redistributing mass forward (i.e., toward front end 101) in club head 100 or backward (i.e., toward read end 104) in club head 100 can also affect the vertical spin rate and/or direction of the golf ball as a result of a gear effect of club head 100 on the golf ball. In some examples, when club head 100 is configured to apply a backward spin direction to the golf ball, moving and/or increasing mass forward (i.e., toward front end 101) in club head 100 (i.e., with weighting mechanism 207 (FIG. 2)) can reduce the gear effect of club head 100 such that the vertical spin rate applied to the golf ball by club head 100 decreases. Conversely, moving and/or increasing mass backward (i.e., toward read end 104) in club head 100 (i.e., with weighting mechanism 207 (FIG. 2)) can increase the gear effect of club head 100 such that the vertical spin rate applied to the golf ball by club head 100 increases. Further, moving and/or increasing mass toward sole 106 can move the club head center of gravity down toward sole 106, thus increasing a gearing effect of club head 100 on the golf ball. Accordingly, in many examples, weighting mechanism 207 (FIG. 2) can be located as near to sole 106 as possible.

Redistributing mass in club head 100 can affect not only the vertical spin rate and/or direction of the golf ball, but also the horizontal spin rate and/or direction of the golf ball. In some examples, when mass is moved and/or increased forward in club head 100, the club head center of gravity of club head 100 can be repositioned forward, decreasing a distance between the center of gravity of club head 100 and a club shaft axis (i.e., a reference axis intersecting a club shaft center of gravity of a club shaft coupled to club head 100 via hosel 109, running collinearly with and/or parallel to the club shaft). Meanwhile, when mass is moved and/or increased backward, the distance between the center of gravity of club head 100 and the club shaft axis increases. Decreasing the distance between the club shaft axis and the club head center of gravity of club head 100 can cause club face 108 to impact the golf ball more openly, which can result in a fade or slice of the golf ball. Conversely, increasing the distance between the club shaft axis and the club head center of gravity of club head 100 can cause club face 108 to be more closed upon impacting the golf ball, which can result in a draw or hook of the golf ball.

Figure 9:
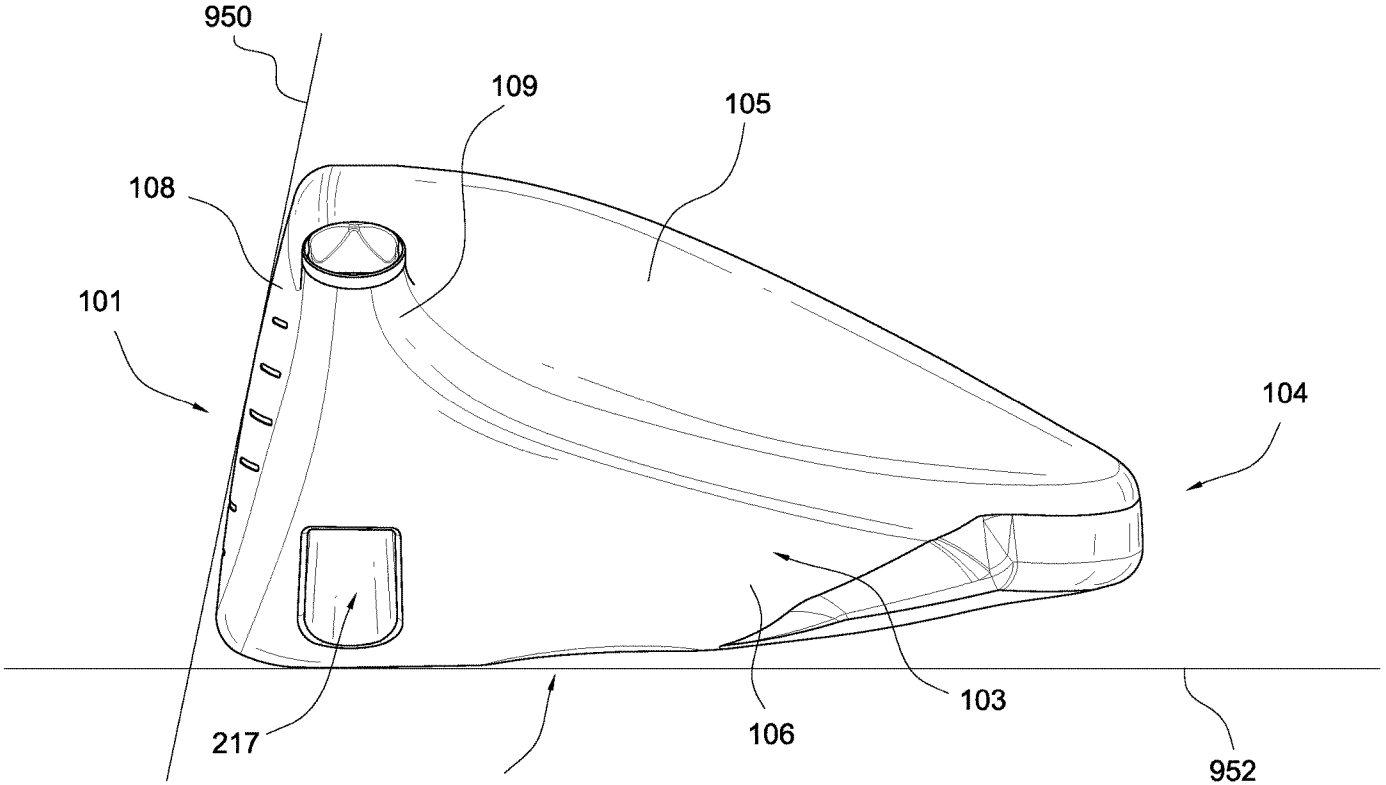
FIG. 9 illustrates a face plane and a ground plane of the club head, according to the embodiment of FIG. 1.
Figure 10:
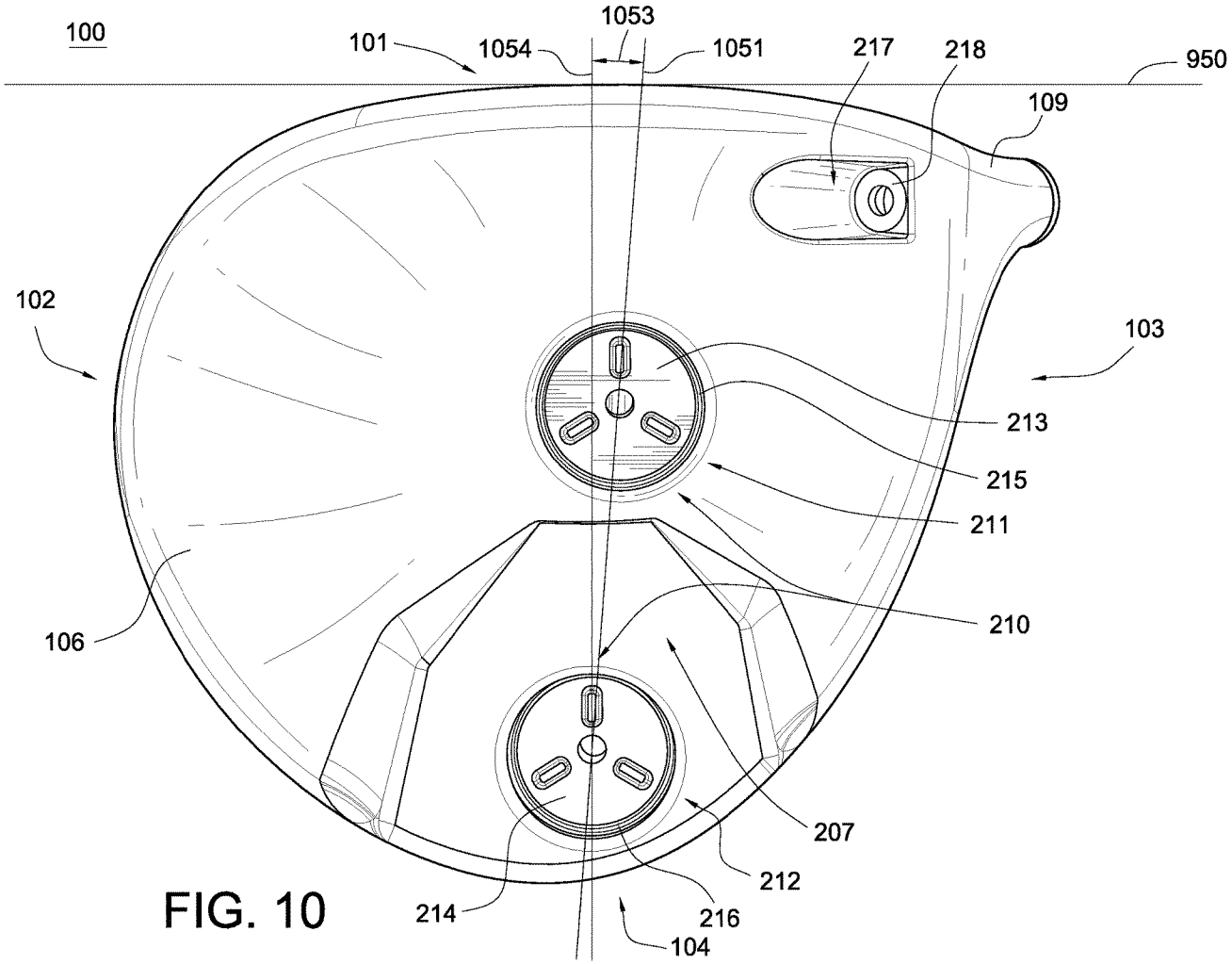
FIG. 10 illustrates a reference angle of a weighting mechanism of the club head with respect to the face plane of the club head, according to the embodiment of FIG. 1.

Because it can be desirable to affect the vertical spin rate and/or direction club head 100 applies to a golf ball while minimally and/or negligibly affecting the horizontal spin rate and/or direction club head 100 applies to the golf ball, weighting mechanism 207 (FIG. 2) can be configured to counter and/or compensate for effects on the horizontal spin rate and/or direction that club head 100 applies to the golf ball design when weighting mechanism 207 (FIG. 2) is adjusted between the multiple configurations of weighting mechanism 207 (FIG. 2). As a result, the horizontal spin rate and/or direction that club head 100 applies to the golf ball when weighting mechanism 207 (FIG. 2) is adjusted between the multiple configurations of weighting mechanism 207 (FIG. 2) can remain approximately constant. Thus, when the fade and/or draw bias is approximately zero for a particular configuration of weighting mechanism 207 (FIG. 2), the fade and/or draw bias can remain approximately zero for other configurations of weighting mechanism 207 (FIG. 2). Weighting mechanism 207 (FIG. 2) can be configured to counter and/or compensate for effects on the horizontal spin rate and/or direction club head 100 applies to the golf ball design when weighting mechanism 207 (FIG. 2) is adjusted between the multiple configurations of weighting mechanism 207 (FIG. 2) by selectively arranging weighting mechanism 207 (FIG. 2) with respect to club face 108 and/or face plane 950 (FIGS. 9 & 10) of club face 108. FIGS. 9 & 10 illustrate the arrangement of weighting mechanism 207 (FIG. 2) with respect to club face 108 (FIG. 1) and/or face plane 950 of club face 108, according to the embodiment of FIG. 1.

Face plane 950 can refer to a reference plane intersecting a foremost point and/or an inflection point in a curvature of club face 108 (FIG. 1) that is parallel to a loft plane of club face 108 and/or club head 100 (FIG. 1). When club face 108 (FIG. 1) is planar and/or substantially planar, club face 108 and face plane 950 can be approximately co-planar to club face 108. However, when club face 108 (FIG. 1) is curved (e.g., non-planar), as can frequently be the case with wood-type golf clubs, face plane 950 can help provide a planar reference marker by which to express the arrangement of weighting mechanism 207 (FIG. 2). Specifically, weighting mechanism 207 (FIG. 2) can be configured such that weighting mechanism 207 (FIG. 2) is arranged at an angle or a curve with respect to club face 108 (FIG. 1) and/or face plane 950. FIG. 9 also illustrates ground plane 952, which can refer to a reference plane parallel and/or co-planar with the ground below club head 100 when club head 100 is positioned to address a golf ball.

Turning ahead to FIG. 10, in many examples, when weighting mechanism 207 (FIG. 2) is arranged at an angle with respect to club face 108 (FIG. 1) and/or face plane 950, weighting mechanism 207 (FIG. 2) can comprise weighting mechanism axis 1051 running parallel to ground plane 952. Weighting mechanism axis 1051 can form reference angle 1053 with centerline 1054. Centerline 1054 can refer to a center reference line that is perpendicular to face plane 950 and that also intersects the foremost point and/or the inflection point in the curvature of club face 108 (FIG. 1). Accordingly, reference angle 1053 can represent an angle that weighting mechanism 207 (FIG. 2) forms with face plane 950. In many examples, weighting mechanism 207 (FIG. 2) can be arranged such that weighting mechanism 207 (FIG. 2) is closer to heel end 103 when weighting mechanism 207 (FIG. 2) is closest to front end 101, and closer to toe end 102 when weighting mechanism 207 (FIG. 2) is closest to rear end 104. That is to say, weighting mechanism axis 1051 can run from front end 101 and heel end 103 toward rear end 104 and toe end 102. Accordingly, reference angle 1053 can open toward front end 101 on a heel side of centerline 1054 and toward rear end 104 on a toe side of centerline 1054.

In some examples, reference angle 1053 can comprise an angle greater than or equal to approximately 2 degrees and less than or equal to approximately 25 degrees. In further examples, reference angle 1053 can comprise an angle greater than or equal to approximately 3 degrees and less than or equal to approximately 13 degrees. In still further examples, reference angle 1053 can comprise an angle greater than or equal to approximately 5 degrees and less than or equal to approximately 8 degrees.

In general, weighting mechanism 207 (FIG. 2) can be arranged in the same or differing arrangements depending on how club head 100 (FIG. 1) is implemented. For example, weighting mechanism 107 207 (FIG. 2) can be arranged the same or differently for a driver versus a 3-wood, 5-wood, etc. In some examples, differing arrangements can still be similar, though different. For example, differing arrangements can both be angled arrangements having different reference angles. However, in other examples, differing arrangements can also differ to a greater extent, such as, for example, where one arrangement is curved and another arrangement is angled, etc.

Further, these same or different arrangements can be applied across some or all of a set of club heads (e.g., of a set of golf clubs) comprising club head 100 and including at least one other club head similar to club head 100, such as, for example, same or different arrangements of a weighting mechanism (e.g., weighting mechanism 207 (FIG. 2)) for two or more club heads of a set of wood-type club heads. Accordingly, in some examples, two or more club heads of a set of club heads (e.g., comprising a driver, 3-wood, and 5-wood club head) can comprise the same or different arrangements for their respective weighting mechanisms. Further, in these or other examples, when the set of club heads comprises at least three club heads, the two or more club heads can comprise the same arrangement to or different arrangements from that of one or more other club heads of the set of club heads for their respective weighting mechanisms.

Turning back in the drawings, FIG. 2 illustrates a bottom, rear perspective view of club head 100, according to the embodiment of FIG. 1. Weighting mechanism 207 can comprise multiple weight ports 210 (e.g., weight port 211, weight port 212). Multiple weight ports 210 can be coupled with and/or integral with sole 106 of club head 100. In many examples, when multiple weight ports 210 are coupled with sole 106, multiple weight ports 210 can be separate from the club head body of club head 100. Further, when multiple weight ports 210 are integral with sole 106, multiple weight ports 210 can be part of the club head body of club head 100.

Figure 14:
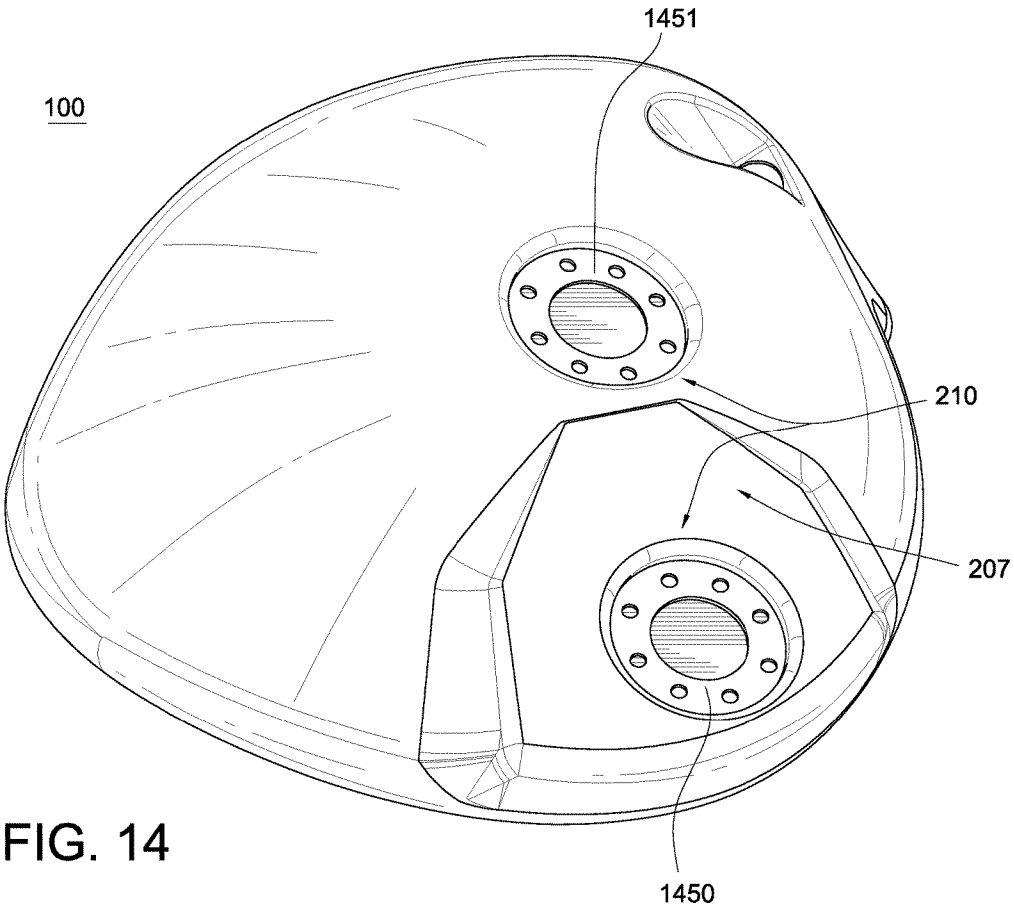
FIG. 14 illustrates the club head of FIG. 1 when multiple weight ports of the weighting mechanism of the club head have received two exemplary weights, according to the embodiment of FIG. 1.
Figure 15:
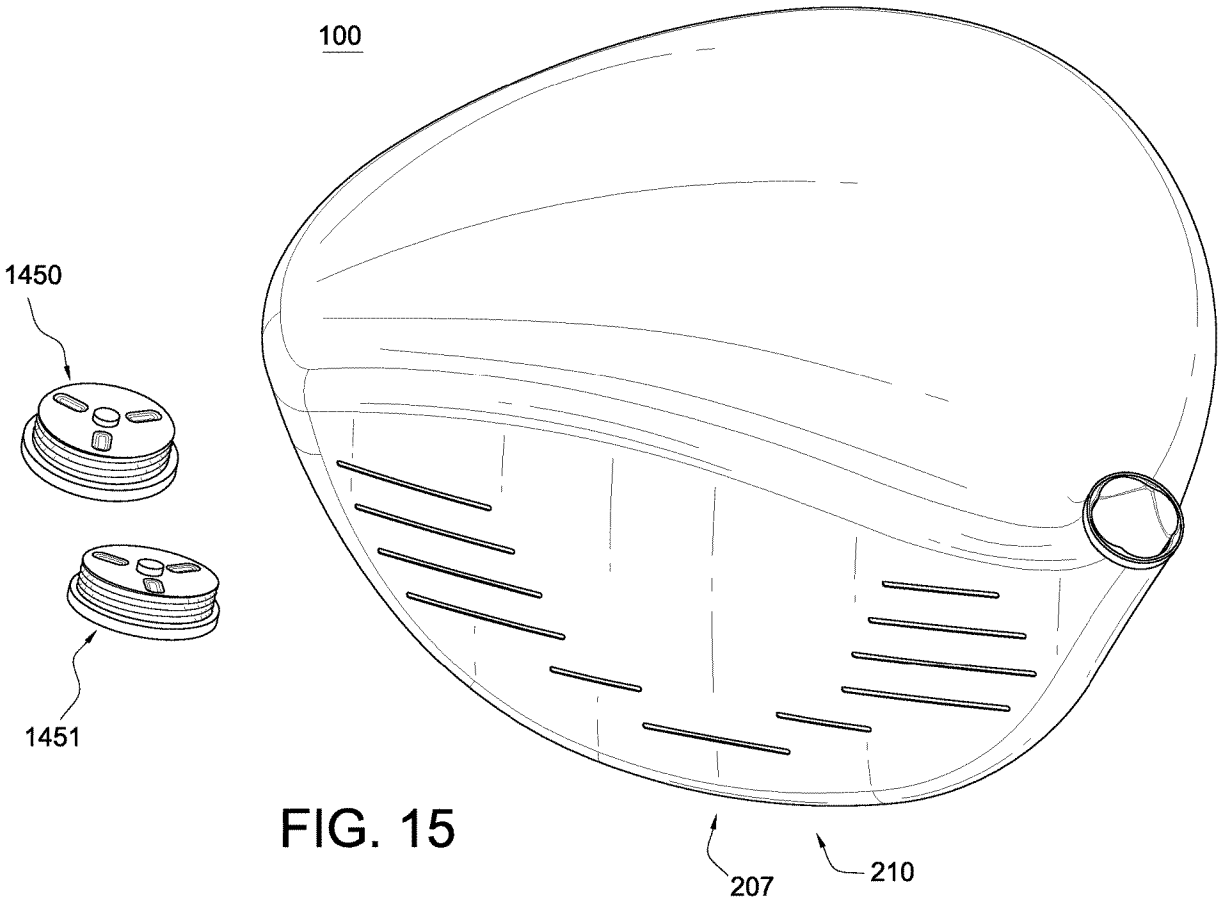
FIG. 15 illustrates the club head of FIG. 1 when the two exemplary weights are decoupled from the multiple weight ports of the weighting mechanism, according to the embodiment of FIG. 1.

Each weight port of multiple weight ports 210 can be configured to receive a weight. Accordingly, in many examples, weighting mechanism 207 can comprise one or more weights configured to be received at multiple weight ports 210. The number of weight(s) can be less than, equal to, or greater than the number of weight ports of multiple weight ports 210. Each weight can comprise approximately the same volume and/or shape so that each weight can be coupled to any of multiple weight ports 210. However, one or more of the weights can comprise a different mass from one or more of the other weights. FIG. 14 illustrates club head 100 when weighting mechanism 207 comprises multiple weight ports 210 having received two exemplary weights 1450 and 1451, according to the embodiment of FIG. 1. Exemplary weights 1450 and 1451 can be similar or identical to the weights as described above with respect to club head 100. FIG. 15 illustrates club head 100 when the exemplary weights 1450 and 1451 are decoupled from multiple weight ports 210 of weighting mechanism 207, according to the embodiment of FIG. 1.

Returning to FIG. 2, club head 100 and/or weighting mechanism 207 can comprise hosel port 217. Hosel port 217 can be positioned at sole 103 opposite hosel 109 at crown 105 (FIG. 1). Hosel port 217 can be configured to receive hosel port bolt 218, which can be configured to couple a club shaft to club head 100.

In some embodiments, multiple weight ports 210 can be limited to two weight ports. In these examples, weighting mechanism 207 can be arranged in an angular arrangement, as described above. In other embodiments, multiple weight ports 210 can comprise more than two weight ports. In these examples, weighting mechanism 207 can be arranged in an angular or curved arrangement, as described above.

Arrangement of the weights (i.e., the masses of the weights) can correspond to the multiple configurations of weighting mechanism 207. Further, omitting one or more of the weights and/or replacing one or more of the weights with a weight comprising more or less mass can also correspond to the multiple configurations of weighting mechanism 207. Accordingly, in many examples, weighting mechanism 207 can comprise as many configurations as there are combinations of arrangements and/or masses of the weights.

For example, placing a weight at weight port 211 comprising a higher mass than a weight placed at weight port 212 can represent a first configuration of the multiple configurations of weighting mechanism 207 and can reduce the gear effect of club head 100 on a golf ball such that the vertical spin applied to the golf ball by club head 100 is less than a vertical spin applied to the golf ball when the weights are placed at weight ports 211 and 212 in a reversed (i.e., second) configuration, and/or when the weights are absent from weight ports 211 and 212. Meanwhile, as indicated, weighting mechanism 207 can be configured in the second configuration when it is desirable to increase the vertical spin applied to the golf ball by club head 100. As indicated above, the vertical spin applied to the golf ball by club head 100 can also be changed and/or tuned by replacing one or both of the weights at weight ports 211 and 212 with weights comprising higher or lower masses. Increasing the differential in the weight masses can increase the extent of the change in the vertical spin applied to the golf ball by club head 100, and decreasing the differential in the weight masses can decrease the extent of the change in the vertical spin applied to the golf ball by club head 100. Changing the weights can represent one or more other configurations of weighting mechanism 207. In still other embodiments, one or more of weight ports 210 can be left empty, representing one or more of the multiple configurations of weighting mechanism 207.

Each of the weights can comprise any suitable shape (e.g., circular, polygonal, etc.). In many examples, each of the weights can comprise a lateral cross-sectional dimension (e.g., diameter or width) equal to approximately 2.36 centimeters for a driver or other club heads. In other examples, other lateral cross sectional dimensions (e.g., diameters) can be implemented for drivers and other club heads. In further examples, each of the weights can comprise a height equal to approximately 0.76 centimeters for a driver or other club heads. In other examples, other heights can be implemented for drivers and other club heads. In general, in many examples, the cross-sectional dimension of the weights can be greater than the height of the weights, such as, for example, by a predetermined width-to-height ratio. In some examples, the width-to-height ratio can be approximately three-to-one. In one example, the ratio, width, and height are the same for all wood-type clubs in a set of golf clubs.

Each weight of the weights can comprise a different mass. The masses of the various weights can be configured to extend over a predetermined range. For example, the masses can range from greater than or equal to approximately 12 grams and less than or equal to approximately 15 grams. In other examples, other masses and/or ranges of masses can be implemented.

Similar to the arrangements of weighting mechanism 207 as described above, the range of masses of the weights can be the same or different when club head 100 comprises different club heads. For example, the range of masses of the weights can be different for a driver versus a 3-wood, 5-wood, etc. The range of masses can be the same or different for each club head of a set of club heads, such as, for example, for each club head of a set of wood-type club heads. Accordingly, each of a driver, 3-wood, and 5-wood club head can comprise different mass ranges, or one or more of the mass ranges for the driver, 3-wood, and 5-wood club heads can be similar or identical to each other.

In order to achieve the various masses of the weights, each weight of the weights can comprise one or more materials. In general and because it can be desirable for each of the weights to comprise a similar or identical volume while also comprising a different mass, in many examples, each weight of the weights can comprise one or more lower mass, volume filling materials (e.g., plastic, metal, metal alloy, composite, etc.) and/or one or more higher mass, weighting materials (e.g., metal, metal alloy, etc.). The filling materials can comprise any suitable polymer(s), metal(s), metal alloy(s), and/or composite material(s). The weighting material(s) can comprise any suitable metal(s) and/or metal alloy(s), such as, for example, comprising iron, aluminum, titanium, lead, tungsten, tin, and/or copper, etc. Other exemplary weighting material(s) can comprise graphite. The weighting material(s) can be injection molded in the filling material(s), such as, for example, to a desired shape. In some examples, the weighting material(s) can be suspended substantially homogenously throughout the filling material(s) as a powder and/or can be located heterogeneously in the filling material(s) as one or more separate bodies. In other examples, the filling material(s) can be overmolded over the weighting material(s). Alternatively, the filling or weighting materials can be omitted, such as, for example, where the weights are at least partially hollow.

Each of the weights can be configured to be mounted in multiple weight ports 210. Although the weights can be configured to be mounted in multiple weight ports 210 in any suitable manner, in many examples, the weights can be threaded about an exterior (e.g., circumferential) wall of the weights and screwed into multiple weight ports 210, which can also be threaded so as to receive the weights. In other examples, multiple weight ports 210 can be configured to receive one or more threaded screws in order to mount the weights at multiple weight ports 210. In some embodiments, single threaded screws can be inserted through a center aperture of each weight of the weights to mount the weights at multiple weight ports 210. In still other embodiments, the threaded screw(s) can be integral with the weights and can extend from a top side of the weights to be screwed in at multiple weight ports 210.

Each weight port of multiple weight ports 210 can comprise one or more port surfaces corresponding to the opposing surfaces of a weight received at that weight port. Accordingly, in many examples, weight port 211 can comprise lateral port surface 213 and orthogonal port surface 215, and/or weight port 212 can comprise lateral port surface 214 and orthogonal port surface 216. Lateral port surface 213 and lateral port surface 214 can correspond to a top surface of the weights to be received at multiple weight ports 210, and orthogonal port surface 215 and orthogonal port surface 216 can correspond to the exterior (e.g., circumferential) walls of the weights to be received at multiple weight ports 210. Accordingly, as applicable, (a) lateral port surface 213 and/or lateral port surface 214 can be configured to receive the threaded screw(s), and/or (b) orthogonal port surface 215 and/or orthogonal port surface 216 can be threaded to receive the threaded exterior walls of the weights. In many examples, by threading orthogonal port surface 215, orthogonal port surface 216, etc. of multiple weight ports 210, the club head center of gravity can be located closer to sole 106 than where the weights are mounted to multiple weight ports 210 at lateral port surface 213, lateral port surface 214, etc. using threaded screw(s). In turn, the weight heights can be shorter, and the weight lateral cross-sectional dimension can be greater when the weights themselves are threaded.

In any event, as indicated above, multiple weight ports 210 are configured to receive the weights. In many examples, each weight port of multiple weight ports 210 receives only a single weight, but in some examples, can receive multiple weights at once. Each weight port of multiple weight ports 210 can comprise a shape and/or volume that substantially corresponds to the shape and/or volume of the weights. Further, each weight port of multiple weight ports 210 can comprise a shape and/or volume configured such that when each weight port of multiple weight ports 210 receives one or more weight(s), the weight(s) are substantially flush with an exterior sole surface of club head 100 at sole 106.

In some embodiments, the weights can comprise one or more ridges and/or grooves at the top surface of the weights configured to contact the lateral port surfaces (e.g., lateral port surface 213, lateral port surface 214, etc.) of multiple weight ports 210 to prevent the weights from rattling when the weights are received at multiple weight ports 210. In further embodiments, a dampening washer can be disposed between the top surface of the weights and the lateral port surfaces (e.g., lateral port surface 213, lateral port surface 214, etc.) of multiple weight ports to prevent the weights from rattling when the weights are received at multiple weight ports 210. In even further embodiments, the weights can be coated in a rubberized paint to prevent the weights from rattling when the weights are received at multiple weight ports 210.

Various additional characteristics of multiple weight ports 210 and the corresponding weights can be configured to affect the vertical spin rate and/or direction that club head 100 applies to a golf ball and/or to minimize or negate an effect on the horizontal spin rate and/or direction that club head 100 applies to the golf ball. For example, as applicable, the lateral port surfaces (e.g., lateral port surface 213, lateral port surface 214, etc.) can be configured to be substantially parallel with an adjacent and/or surrounding portion of sole 106 and/or the orthogonal port surfaces (e.g., orthogonal port surface 215, orthogonal port surface 216, etc.) can be configured to be substantially orthogonal to the adjacent and/or surrounding portion of sole 106. Further, a ratio of the height of the weights and/or multiple weight ports 210 to a height of club head 100 (i.e., a distance between crown 105 and sole 106) can be minimized so that the weights are positioned as close to sole 106 as possible. Further still, multiple weight ports 210 and/or the weights can be configured with a shape and/or volume that (a) minimizes a height of multiple weight ports 210 and/or the weights and/or (b) maximizes a lateral cross-sectional dimension (e.g., diameter) of multiple weight ports 210 and/or the weights. Also, the volume of the weights versus that of multiple weight ports 210 can be configured so that the volume of the weights exceeds that of the volume of multiple weight ports 210 by as much as possible. Likewise, in some examples, multiple weight ports 210 can be configured to minimize a vertical rise between multiple weight ports 210 along sole 106.

In some embodiments, the weight can be configured to be coupled with and/or removed from multiple weight ports 210 using the same tool as can be used to couple a club shaft to hosel 109 via hosel port 217 and hosel port bolt 218.

Figure 3:
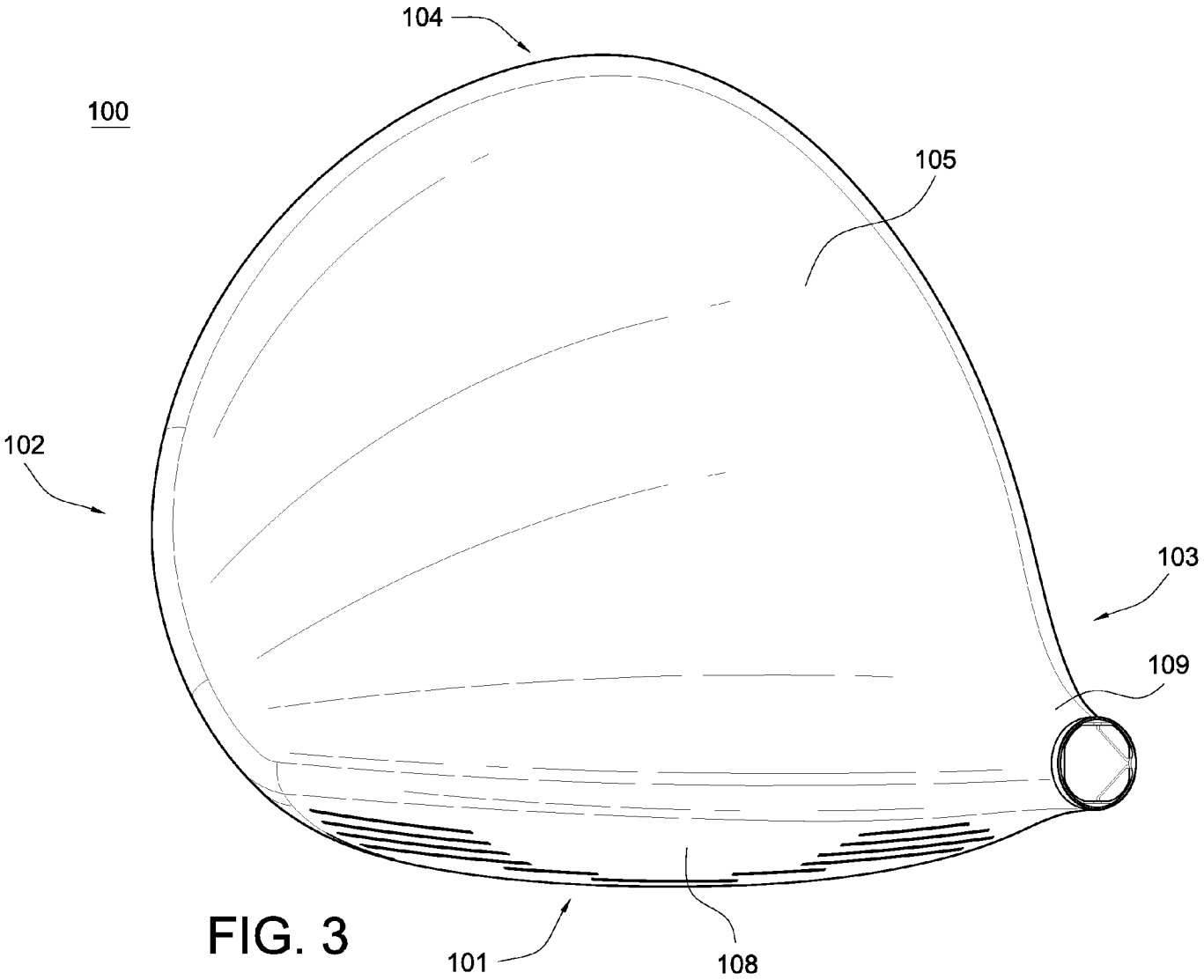
FIG. 3 is a top view of the club head, according to the embodiment of FIG. 1.
Figure 4:
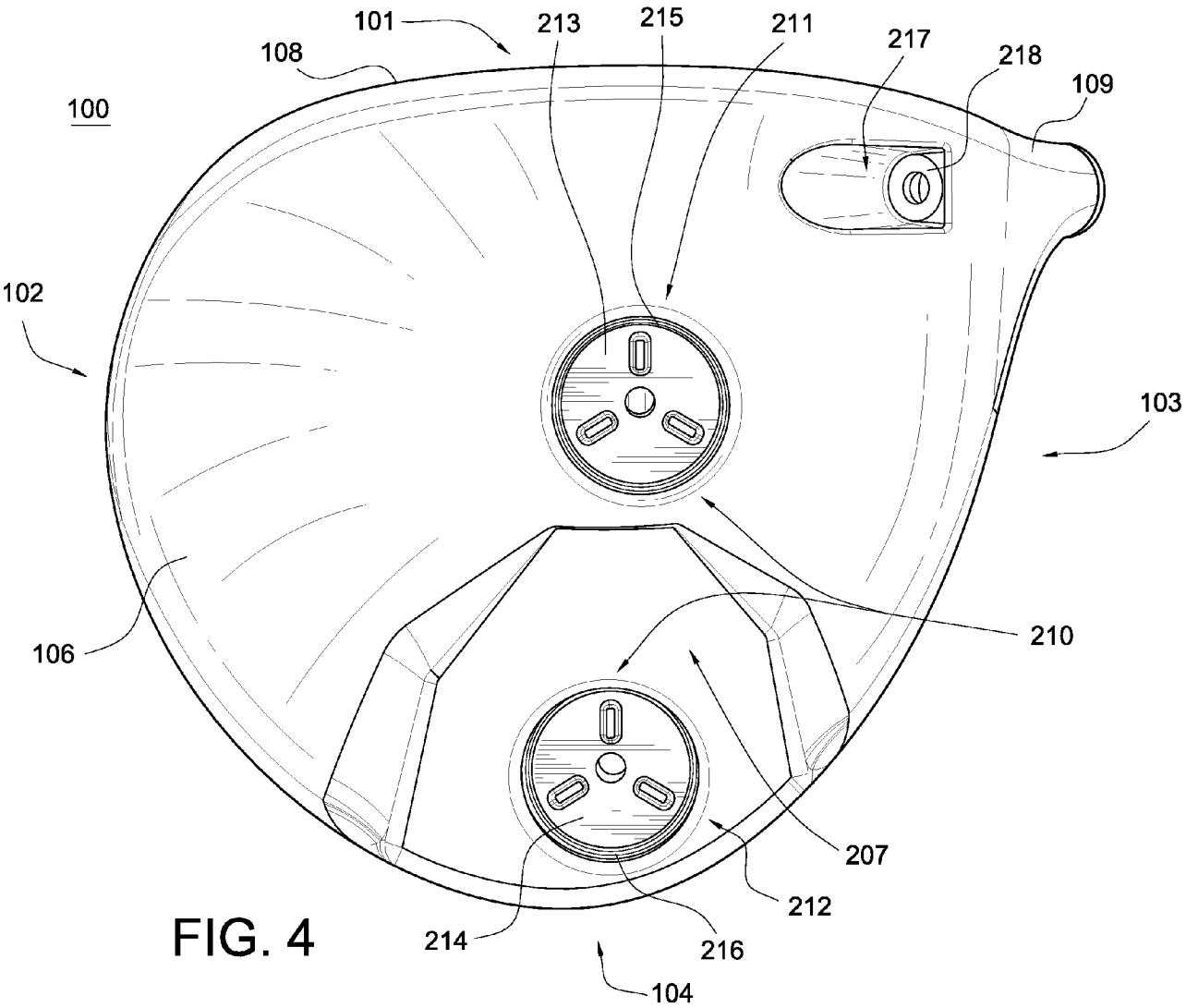
FIG. 4 is a bottom view of the club head, according to the embodiment of FIG. 1.
Figure 5:
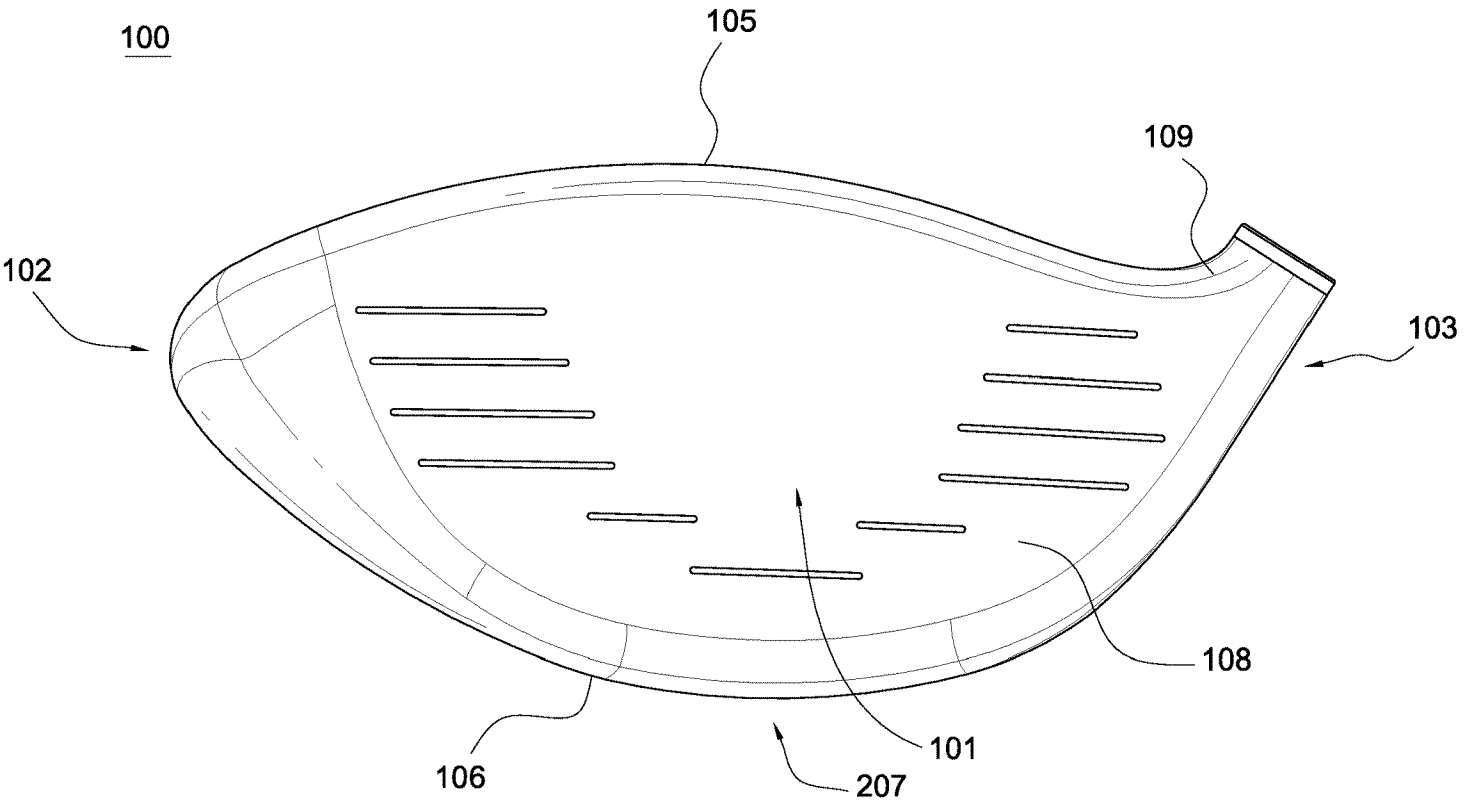
FIG. 5 is a front view of the club head, according to the embodiment of FIG. 1.
Figure 6:
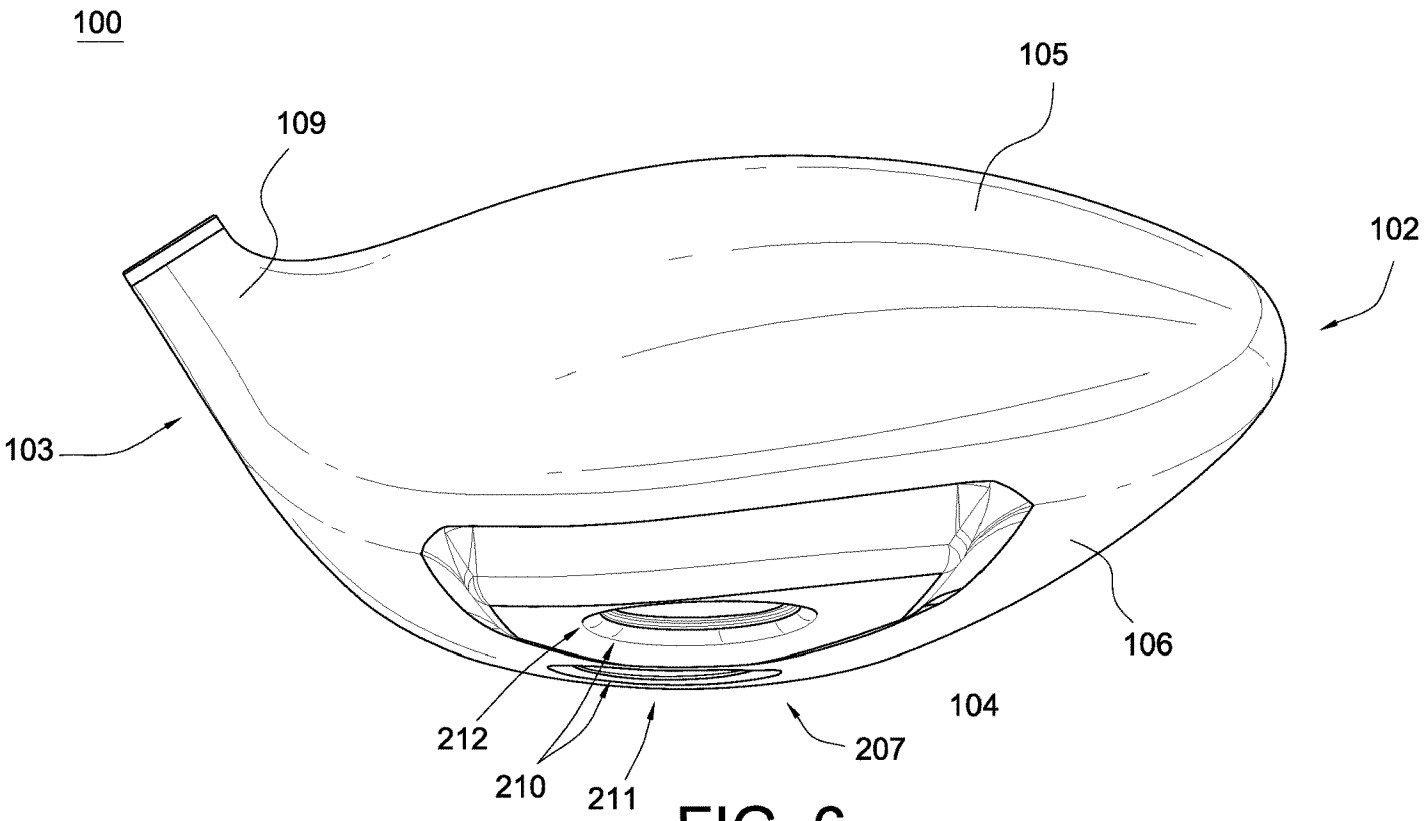
FIG. 6 is a rear view of the club head, according to the embodiment of FIG. 1.
Figure 7:
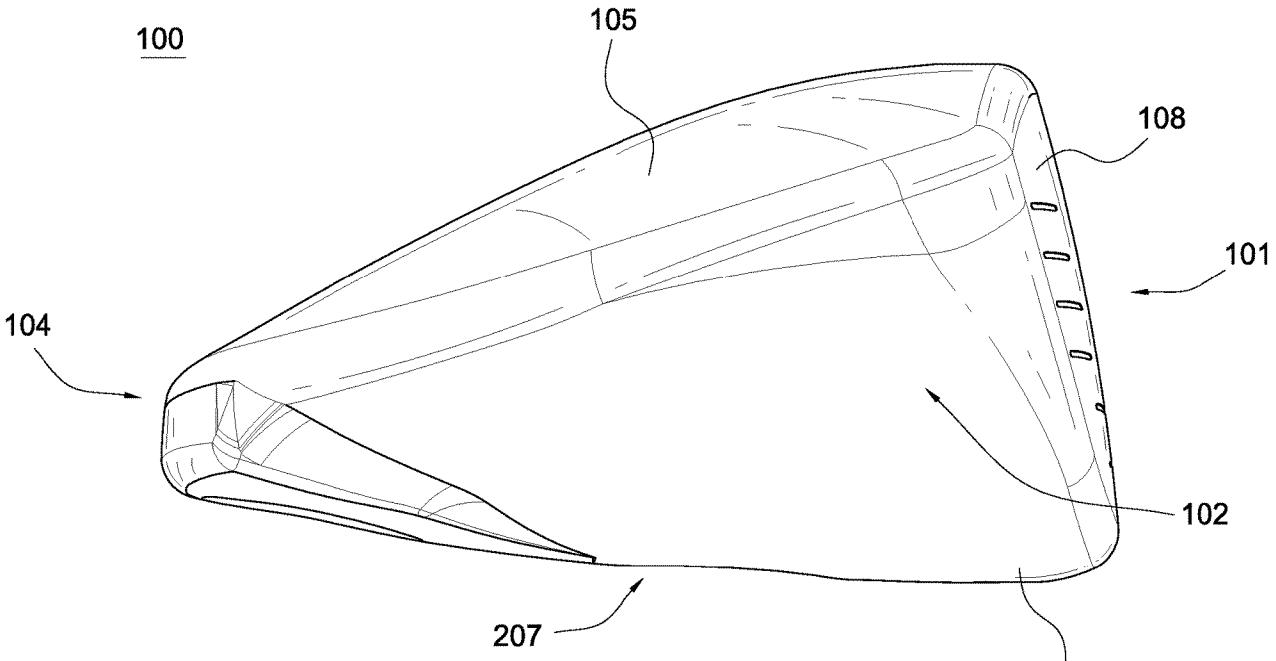
FIG. 7 is a left view of the club head, according to the embodiment of FIG. 1.
Figure 8:
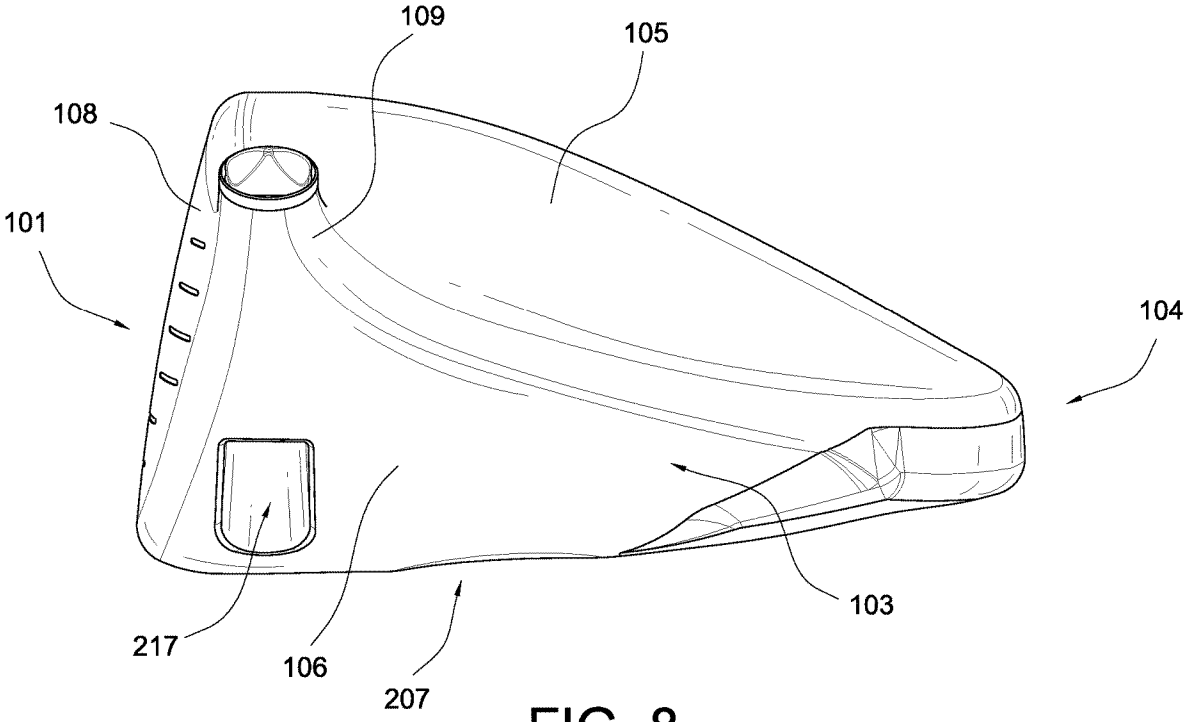
FIG. 8 is a right view of the club head, according to the embodiment of FIG. 1.

FIGS. 3-8 illustrate club head 100 from various other viewing angles. Specifically, FIG. 3 is a top view of club head 100, according to the embodiment of FIG. 1; FIG. 4 is a bottom view of club head 100, according to the embodiment of FIG. 1; FIG. 5 is a front view of club head 100, according to the embodiment of FIG. 1; FIG. 6 is a rear view of club head 100, according to the embodiment of FIG. 1; FIG. 7 is a left view of club head 100, according to the embodiment of FIG. 1; and FIG. 8 is a right view of club head 100, according to the embodiment of FIG. 1.

In some embodiments, weighting mechanism 207 can comprise a channel instead of multiple weight ports 210. However, the channel can be similar to one weight port of multiple weight ports 210. In these embodiments, one or more weights can be disposed within the channel and adjusted to a location within the channel to adjust weighting mechanism 207 between the multiple configurations of weighting mechanism 207. Further, in these embodiments, the weight(s) can be similar to the weights described above, but the weights can be configured to be non-removable from the channel and can be slid from one position to another along the channel. This implementation can prevent the weight(s) from being lost and can simplify adjustment of the weights for a user of club head 100.

In other embodiments, multiple weight ports 210 can be linked by a bridging channel running between, and if applicable, through, multiple weight ports 210. In these embodiments, the weight(s) configured to be inserted in multiple weight ports 210 can be integrated into an integrated weight system coupling the individual weights together via a bridging portion corresponding to the bridging channel. By limiting the resulting combinations of configurations for weighting system 207, implementing weighting mechanism 207 so that multiple weight ports 210 are linked by the bridging channel can also simply adjustment of the weights (i.e., the integrated weight system) for a user of club head 100. In some embodiments, the bridging channel can be shallower than multiple weight ports 210.

In many embodiments, club head 100 can comprise one or more branding and/or other symbols, such as, for example, to indicate a manufacturer of club head 100. In other embodiments, the branding and/or other symbol(s) can be omitted.

Figure 11:
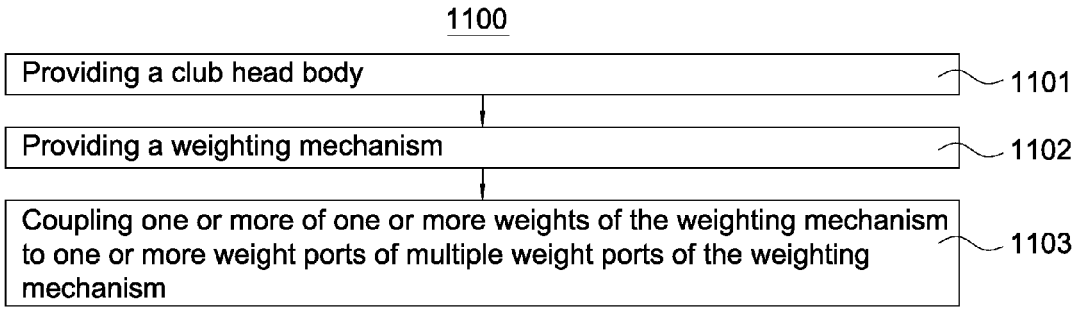
FIG. 11 illustrates a flow chart for an embodiment of a method of providing a club head.

Turning ahead in the drawings, FIG. 11 illustrates a flow chart for an embodiment of method 1100 of providing a club head. Method 1100 is merely exemplary and is not limited to the embodiments presented herein. Method 1100 can be employed in many different embodiments or examples not specifically depicted or described herein. In some embodiments, the activities, the procedures, and/or the processes of method 1100 can be performed in the order presented. In other embodiments, the activities, the procedures, and/or the processes of method 1100 can be performed in any other suitable order. In still other embodiments, one or more of the activities, the procedures, and/or the processes in method 1100 can be combined or skipped. In many embodiments, the club head can be similar or identical to club head 100 (FIGS. 1-10, 14, & 15).

Figure 12:
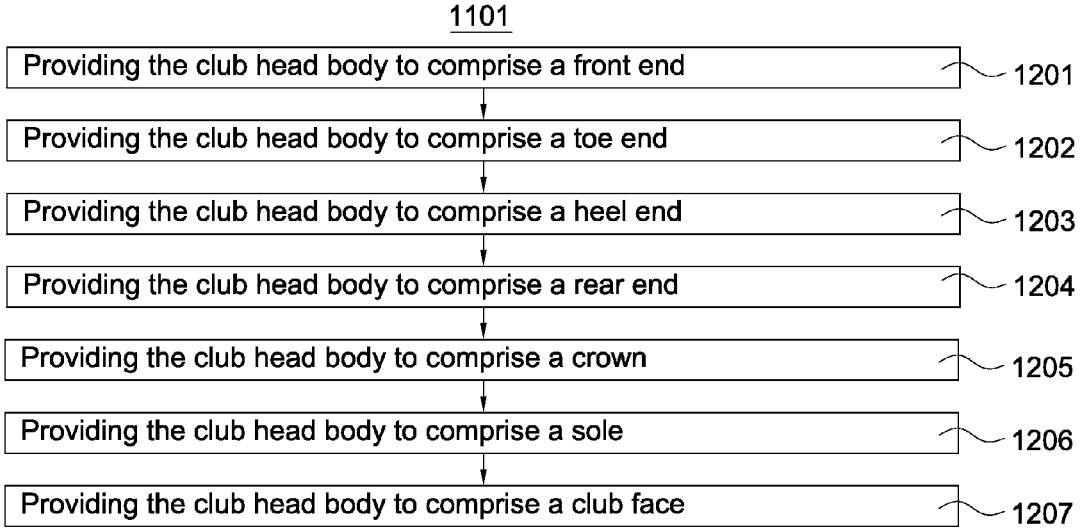
FIG. 12 illustrates an exemplary method of providing a club head body, according to the embodiment of FIG. 11.

Method 1100 can comprise activity 1101 of providing a club head body. The club head body can be similar or identical to the club head body described above with respect to club head 100 (FIGS. 1-10, 14, & 15). In some embodiments, activity 1101 can comprise machining, forming, and/or molding the club head body. FIG. 12 illustrates an exemplary activity 1101, according to the embodiment of FIG. 11.

Activity 1101 can comprise activity 1201 of providing the club head body to comprise a front end. The front end can be similar or identical to front end 101 (FIGS. 1-5 & 7-10).

Activity 1101 can comprise activity 1202 of providing the club head body to comprise a toe end. The toe end can be similar or identical to toe end 102 (FIGS. 1-7 & 10).

Activity 1101 can comprise activity 1203 of providing the club head body to comprise a heel end. The heel end can be similar or identical to heel end 103 (FIGS. 1-6 & 8-10).

Activity 1101 can comprise activity 1204 of providing the club head body to comprise a rear end. The rear end can be similar or identical to rear end 104 (FIGS. 1-4 & 6-10).

Activity 1101 can comprise activity 1205 of providing the club head body to comprise a crown. The crown can be similar or identical to crown 105 (FIGS. 1-3 & 5-9).

Activity 1101 can comprise activity 1206 of providing the club head body to comprise a sole. The sole can be similar or identical to sole 106 (FIGS. 1, 2, & 4-10). In some embodiments of one or more of activity 1101 and activities 1201-1206 can be performed simultaneously with each other.

Activity 1101 can comprise activity 1207 of providing the club head body to comprise a club face. The club face can be similar or identical to club face 108 (FIGS. 1-5 & 7-9).

Figure 13:
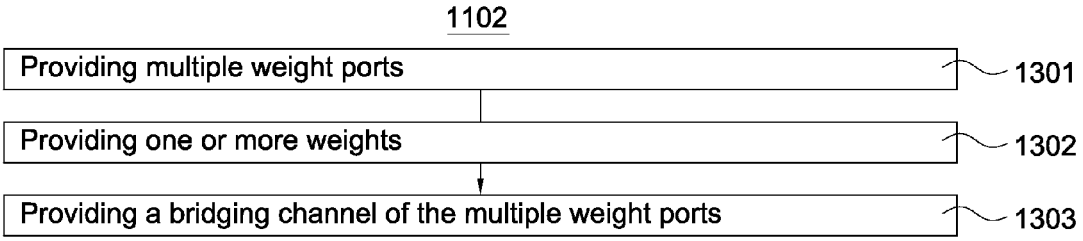
FIG. 13 illustrates an exemplary method of providing a weighting mechanism, according to the embodiment of FIG. 11.

Turning back to FIG. 11, method 1100 can comprise activity 1102 of providing a weighting mechanism. The weighting mechanism can be similar or identical to weighting mechanism 207 (FIGS. 2, 4-10, 14, & 15). In some embodiments, at least part of activity 1102 can be performed as part of activity 1101. Further, in some embodiments, activity 1102 can comprise machining, forming, and/or molding the at least part of the weighting mechanism. FIG. 13 illustrates an exemplary activity 1102, according to the embodiment of FIG. 11.

In many examples, activity 1102 can comprise activity 1301 of providing multiple weight ports. The multiple weight ports can be similar or identical to weight ports 210 (FIGS. 2, 4-10, 14, & 15). In some examples, activity 1301 can comprise coupling the multiple weight ports to the sole of the club head. In other examples, activity 1301 can be part of activity 1206 (FIG. 12), such as, for example, when the multiple weight ports are integral with the sole of the club head.

Further, activity 1102 can comprise activity 1302 of providing one or more weights. The weight(s) can be similar or identical to the weight(s) described above with respect to club head 100 (FIGS. 1-10, 14, & 15). For example, the weight(s) can be similar or identical to weight 1450 (FIGS. 14 & 15) and/or weight 1451 (FIGS. 14 & 15).

In some examples, activity 1102 can comprise activity 1303 of providing a bridging channel of the multiple weight ports. The bridging channel can be similar or identical to the bridging channel described above with respect to club head 100 (FIGS. 1-10, 14, & 15). In other embodiments, activity 1303 can be omitted.

In other examples, activities 1301 and 1303 can be replaced with an activity of providing a channel. The channel can be similar or identical to the channel described above with respect to club head 100 (FIGS. 1-10, 14, & 15). However, in various embodiments, this activity of providing a channel can be omitted.

Returning again to FIG. 11, method 1100 can also comprise activity 1103 of coupling one or more of the one or more weights to one or more weight ports of the multiple weight ports. In other embodiments, activity 1103 can be omitted.

Although the apparatuses, methods, and/or articles of manufacture described herein have been described with reference to specific embodiments, it will be understood by those skilled in the art that various changes may be made without departing from the spirit or scope of the invention. Accordingly, the disclosure of embodiments of the apparatuses, methods, and/or articles of manufacture are intended to be illustrative of the scope of the invention and are not intended to be limiting. It is intended that the scope of the apparatuses, methods, and/or articles of manufacture shall be limited only to the extent required by the appended claims. For example, to one of ordinary skill in the art, it will be readily apparent that any of the activities of FIGS. 11-13 may be comprised of many different procedures, processes, and activities and be performed by many different modules, in many different orders, that any element of FIGS. 1-15 may be modified, and that the foregoing discussion of certain of these embodiments does not necessarily represent a complete description of all possible embodiments.

Further, while the above examples may be described in connection with a wood-type golf club head, the apparatuses, methods, and/or articles of manufacture described herein may be applicable to other types of golf clubs such as an iron-type golf club, a wedge-type golf club, or a putter-type golf club. Further still, the apparatuses, methods, and/or articles of manufacture described herein may be applicable to other types of sports equipment such as a hockey stick, a tennis racket, a fishing pole, a ski pole, etc.

Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claim.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatuses, methods, and/or articles of manufacture described herein may be conforming or non-conforming to the rules of golf at any particular time. Accordingly, golf equipment related to the apparatuses, methods, and/or articles of manufacture described herein may be advertised, offered for sale, and/or sold as conforming or non-conforming golf equipment. The apparatuses, methods, and/or articles of manufacture of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:

a club head body comprising a front end, a rear end opposite the front end, a toe end, a heel end opposite the toe end, and a sole; and a weighting mechanism;

a part of the weighting mechanism is coupled with the sole;

wherein:

the weighting mechanism comprises a first configuration and a second configuration;

the weighting mechanism comprises multiple weight ports and at least one weight;

the multiple weight ports are located only at the sole;

the multiple weight ports are arranged in a straight line and at an angle relative to a face plane of the golf club head such that the weighting mechanism toward the front end is closer to the heel end than to the toe end and such that the weighting mechanism toward the rear end is closer to the toe end than to the heel end relative to the weighting mechanism toward the front end, the angle being measured approximately parallel to a ground plane of the golf club head when the golf club head is at address, and the angle is greater than or equal to approximately 2 degrees and less than or equal approximately to 25 degrees;

each of the multiple weight ports is configured to receive the at least one weight;

when the weighting mechanism is configured in the first configuration and a user hits a golf ball with the golf club head in a predetermined manner, the golf ball breaks contact with the golf head (i) with a first vertical spin rate, (ii) with a first horizontal spin rate, and (iii) with a first horizontal spin direction;

when the weighting mechanism is configured in the second configuration and the user hits the golf ball with the golf club head in the predetermined manner, the golf ball breaks contact with the golf club head (i) with a second vertical spin rate, (ii) with approximately the first horizontal spin rate; and (iii) with approximately the first horizontal spin direction;

when the golf club head is at address, a vertical axis of rotational inertia extends vertically through a center of gravity of the golf club head;

when the weighting mechanism is configured in the first configuration, the golf club head comprises a first moment of inertia about the vertical axis of rotational inertia;

when the weighting mechanism is configured in the second configuration, the golf club head comprises a second moment of inertia about the vertical axis of rotational inertia; and the second vertical spin rate is different than the first vertical spin rate, and the first moment of inertia is different than the second moment of inertia.

2. The golf club head of claim 1 wherein:

the angle is greater than or equal to approximately 3 degrees and less than or equal to approximately 13 degrees.

3. The golf club head of claim 1 wherein:

the angle is greater than or equal to approximately 5 degrees and less than or equal to approximately 8 degrees.

4. The golf club head of claim 1 wherein:

each weight material comprises any suitable metals, or metal alloy, such as iron, aluminum, titanium, lead, tungsten, tin, or copper;

at least one weight can comprise of one or more lower mass, volume filling materials such as plastic, metal alloy, or composites;

at least one weight can comprise of one or more higher mass, volume filling material such as metal, or metal alloys;

each weight of the at least one weight comprises a mass that is greater than or equal to approximately 12 grams and less than or equal to approximately 15 grams.

5. The golf club head of claim 1 wherein:

each weight can comprise any suitable shape such as circular, or polygonal.

6. The golf club head of claim 1 wherein:

each weight of the at least one weight comprises a lateral cross sectional dimension and a height when inserted into the multiple weight ports;

the lateral cross-sectional dimension is approximately three times larger than the height.

7. The golf club head of claim 1 wherein:

the golf club head comprises a wood-type golf club head.

8. The golf club head of claim 1 wherein:

when the weighting mechanism is configured in the first configuration and the user hits the golf ball with the golf club head in the predetermined manner, the golf ball breaks contact with the golf club head with a first vertical spin direction; and when the weighting mechanism is configured in the second configuration and the user hits the golf ball with the golf club head in the predetermined manner, the golf ball breaks contact with the golf club head with a second vertical spin direction different than the first vertical direction.

9. The golf club head of claim 1 wherein:

the at least one weight comprises multiple weights; and each weight port of the multiple weight ports is configured to receive one weight of the multiple weights.

10. The golf club head of claim 9 wherein:

each weight of the multiple weights comprises a volume, a shape, and a mass;

the volume of each weight of the multiple weights is approximately equal;

the shape of each weight of the multiple weights is approximately equal; and the mass of each weight of the multiple weights is different for each weight of the multiple weights.

11. The golf club head of claim 9 wherein:

the multiple weight ports comprise a first weight port and a second weight port;

the multiple weights comprise a first weight and a second weight;

when the first weight port receives the first weight and the second weight port receives the second weight, the weighting mechanism is configured in the first configuration; and when the first weight port receives the second weight and the second weight port receives the first weight, the weighting mechanism is configured in the second configuration.

12. The golf club head of claim 1 wherein:

the weighting mechanism comprises a third configuration;

when the weighting mechanism is configured in the third configuration and the user hits the golf ball with the golf club head in the predetermined manner, the golf ball breaks contact with the golf club head (i) with a third vertical spin rate, (ii) with approximately the first horizontal spin rate, and (iii) with approximately the first horizontal spin direction; and the third vertical spin rate is different than the first vertical spin rate and the second vertical spin rate.

13. The golf club head of claim 1 wherein:

each weight of the at least one weight is configured to be mounted in the multiple weight ports via at least one of threading about an exterior wall of the each weight or a screw.

14. The golf club head of claim 1 wherein:

each weight of the at least one weight comprises at least one of (a) one or more ridges at a top surface of the each weight, or (b) a rubberized paint coating.

15. The golf club head of claim 1 wherein:

the multiple weight ports comprises at least two weight ports.

16. A method of providing a golf club head, the method comprising:

providing a club head body comprising a front end, a rear end opposite the front end, a toe end, a heel end opposite the toe end, and a sole; and providing a weighting mechanism;

coupling a part of the weighting mechanism to the sole; wherein:

the weighting mechanism comprises a first configuration and a second configuration;

providing the weighting mechanism comprises providing multiple weight ports and at least one weight;

the multiple weight ports are located only at the sole;

the multiple weight ports are arranged in a straight line at an angle relative to a face plane of the golf club head such that the weighting mechanism toward the front end is closer to the heel end than to the toe end and such that the weighting mechanism toward the rear end is closer to the toe end than to the heel end relative to the weighting mechanism toward the front end, the angle being measured approximately parallel to a ground plane of the golf club head when the golf club head is at address, and the angle is greater than or equal to approximately 2 degrees and less than or equal approximately to 25 degrees;

each of the multiple weight ports is configured to receive the at least one weight;

when the weighting mechanism is configured in the first configuration and a user hits a golf ball with the golf club head in a predetermined manner, the golf ball breaks contact with the golf club head (i) with a first vertical spin rate, (ii) with a first horizontal spin rate, and (iii) with a first horizontal spin direction;

when the weighting mechanism is configured in the second configuration and the user hits the golf ball with the golf club head in the predetermined manner, the golf ball breaks contact with the golf club head (i) with a second vertical spin rate, (ii) with approximately the first horizontal spin rate, and (iii) with approximately the first horizontal spin direction;

when the golf club head is at address, a vertical axis of rotational inertia extends vertically through a center of gravity of the golf club head;

when the weighting mechanism is configured in the first configuration, the golf club head comprises a first moment of inertia about the vertical axis of rotational inertia;

when the weighting mechanism is configured in the second configuration, the golf club head comprises a second moment of inertia about the vertical axis of rotational inertia; and the second vertical spin rate is different than the first vertical spin rate, and the first moment of inertia is different than the second moment of inertia.

17. The method of claim 16 wherein:

each weight material comprises any suitable metals, or metal alloy, such as iron, aluminum, titanium, lead, tungsten, tin, or copper;

at least one weight can comprise of one or more lower mass, volume filling materials such as plastic, metal alloy, or composites;

at least one weight can comprise of one or more higher mass, volume filling material such as metal, or metal alloys;

each weight comprises a mass that is greater than or equal to approximately 12 grams and less than or equal to approximately 15 grams.

18. The method of claim 17 wherein:

each weight of the at least one weight comprises a lateral cross-sectional dimension and a height when inserted into the multiple weight ports;

the lateral cross-sectional dimensions is approximately three times larger than the height.

19. The method of claim 17 wherein:

providing the multiple weight ports and the at least one weight comprises providing multiple weights, each weight port of the multiple weight ports being configured to receive one weight of the multiple weights.

* * * * *